US009234651B2

(12) United States Patent
Ohai

(10) Patent No.: US 9,234,651 B2
(45) Date of Patent: Jan. 12, 2016

(54) LIGHTING FIXTURE MOUNTING POST

(71) Applicant: Jeffrey Ohai, Riverside, CA (US)

(72) Inventor: Jeffrey Ohai, Riverside, CA (US)

( * ) Notice: Subject to any disclaimer, the term of this patent is extended or adjusted under 35 U.S.C. 154(b) by 269 days.

(21) Appl. No.: 14/054,535

(22) Filed: Oct. 15, 2013

(65) Prior Publication Data

US 2014/0119030 A1 May 1, 2014

Related U.S. Application Data

(63) Continuation-in-part of application No. 12/906,404, filed on Oct. 18, 2010, now Pat. No. 8,556,477.

(51) Int. Cl.

| | |
|---|---|
| ***F21S 8/06*** | (2006.01) |
| ***F21V 17/06*** | (2006.01) |
| ***F21V 21/10*** | (2006.01) |
| ***F21V 21/104*** | (2006.01) |
| ***F21V 1/00*** | (2006.01) |
| ***F21V 17/12*** | (2006.01) |

(52) U.S. Cl.

CPC ..... *F21V 17/06* (2013.01); *F21S 8/063* (2013.01); *F21V 1/00* (2013.01); *F21V 17/12* (2013.01); *F21V 21/10* (2013.01); *F21V 21/104* (2013.01)

(58) Field of Classification Search

CPC ..... F21S 48/063; F21S 8/063; F21V 17/06; F21V 21/10; F21V 21/104

USPC ..... 362/147–148, 404, 408, 410–415

See application file for complete search history.

(56) References Cited

U.S. PATENT DOCUMENTS

| | | | | |
|---|---|---|---|---|
| 1,882,312 | A | 10/1932 | Aspinwall | |
| 1,985,582 | A | 12/1934 | Schwinger | |
| 2,111,357 | A | 3/1938 | Cornell, Jr. | |
| 2,446,736 | A | 8/1948 | Biller | |
| 5,584,559 | A | 12/1996 | Toda | |
| 5,690,424 | A | 11/1997 | Warshauer et al. | |
| 5,845,882 | A | 12/1998 | Hodges et al. | |
| 6,538,201 | B1 * | 3/2003 | Gretz | H02G 3/0691 16/2.1 |
| 6,547,413 | B2 | 4/2003 | Hung | |
| 6,679,620 | B2 | 1/2004 | Patz et al. | |
| 7,401,950 | B2 | 7/2008 | Larouche | |
| 8,556,477 | B2 | 10/2013 | Ohai | |
| 2004/0165394 | A1 | 8/2004 | Pusch | |
| 2012/0092881 | A1 * | 4/2012 | Ohai | F21V 17/06 362/433 |

* cited by examiner

*Primary Examiner* — Sean Gramling

(74) *Attorney, Agent, or Firm* — Kenneth L. Green; Averill & Green

(57) ABSTRACT

A light fixture mounting post includes an upper threaded portion for attaching the post to a light shade and a lower portion for attaching light fixtures to the post. The upper threaded portion has left handed threads, and an O-ring and a shaped rubber washer residing between a post nut and the shade. A post flange limits the insertion depth of the upper threaded portion through the shade. The threaded segments include right handed pipe threads for tightly engaging the light fixtures. Embodiments include a continuous lower portion with straight or tapered threads and a segmented lower portion with reduced thickness spaces separating the taper or straight threaded segments allowing easy shortening of the lower portion.

6 Claims, 5 Drawing Sheets

LIGHTING FIXTURE MOUNTING POST

The present application is a Continuation In Part of U.S. patent application Ser. No. 12/906,404 filed Oct. 18, 2010, which application is incorporated in its entirety herein by reference.

BACKGROUND OF THE INVENTION

The present invention relates to light fixtures and in particular to light fixture mounting posts.

Known light fixture mounting posts comprise a hollow threaded tube which is screwed into a base unit and a light fixture is screwed onto, with wiring running through the tube into the light fixture. A single post length is often not suitable for a specific installation, or the tube requires a nut to tighten to fix the position of the light fixture on the tube, and such nuts are often very difficult to tighten, resulting in a loose fixture.

BRIEF SUMMARY OF THE INVENTION

The present invention addresses the above and other needs by providing a light fixture mounting post which includes an upper threaded portion for attaching the post to a light shade and a lower portion for attaching light fixtures to the post. The upper threaded portion has left handed threads, and an O-ring and a shaped rubber washer residing between a post nut and the shade. A post flange limits the insertion depth of the upper threaded portion through the shade. The threaded segments include right handed pipe threads for tightly engaging the light fixtures. Embodiments include a continuous lower portion with straight or tapered threads and a segmented lower portion with reduced thickness spaces separating the taper or straight threaded segments allowing easy shortening of the lower portion. shoulder which facilitates the attachment of known light fixtures.

In accordance with one aspect of the invention, there is provided a light fixture mounting post having a plurality of segments, wherein each segment includes a new tapered thread. The post is cut to the desired length, and the fixture is screwed onto the tapered thread until it is tight, therefore not requiring a nut because of the taper, and correctly positioning the light fixture.

In accordance with another aspect of the invention, there is provided a continuous light fixture mounting post having either straight or tapered thread.

In accordance with still another aspect of the invention, there is provided a light fixture mounting post having a short unthreaded shoulder between sequential threaded segments. The vertical positioning of light fixtures is often critical in obtaining a desired light appearance. Each threaded segment includes tapered pipe threads which limit the ability to vertically position the light fixtures and in some instances there is a need to position the light fixtures lower. Providing the unthreaded shoulder (shorter than the threaded segments) allows additional options for vertically positioning the light fixture.

In accordance with yet another aspect of the invention, there is provided a light fixture mounting post having a hexagonal shoulder which engages a hexagonal passage in a light shade to prevent the mounting post from rotating in the light shade when a light fixture is attached or removed from the taper threaded post.

In accordance with still another aspect of the invention, there is provided a light fixture mounting post having left handed threads on an upper portion which engages the light shade to prevent the mounting post from rotating in the light shade when a light fixture is removed from the taper threaded post.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figures 1, 2:
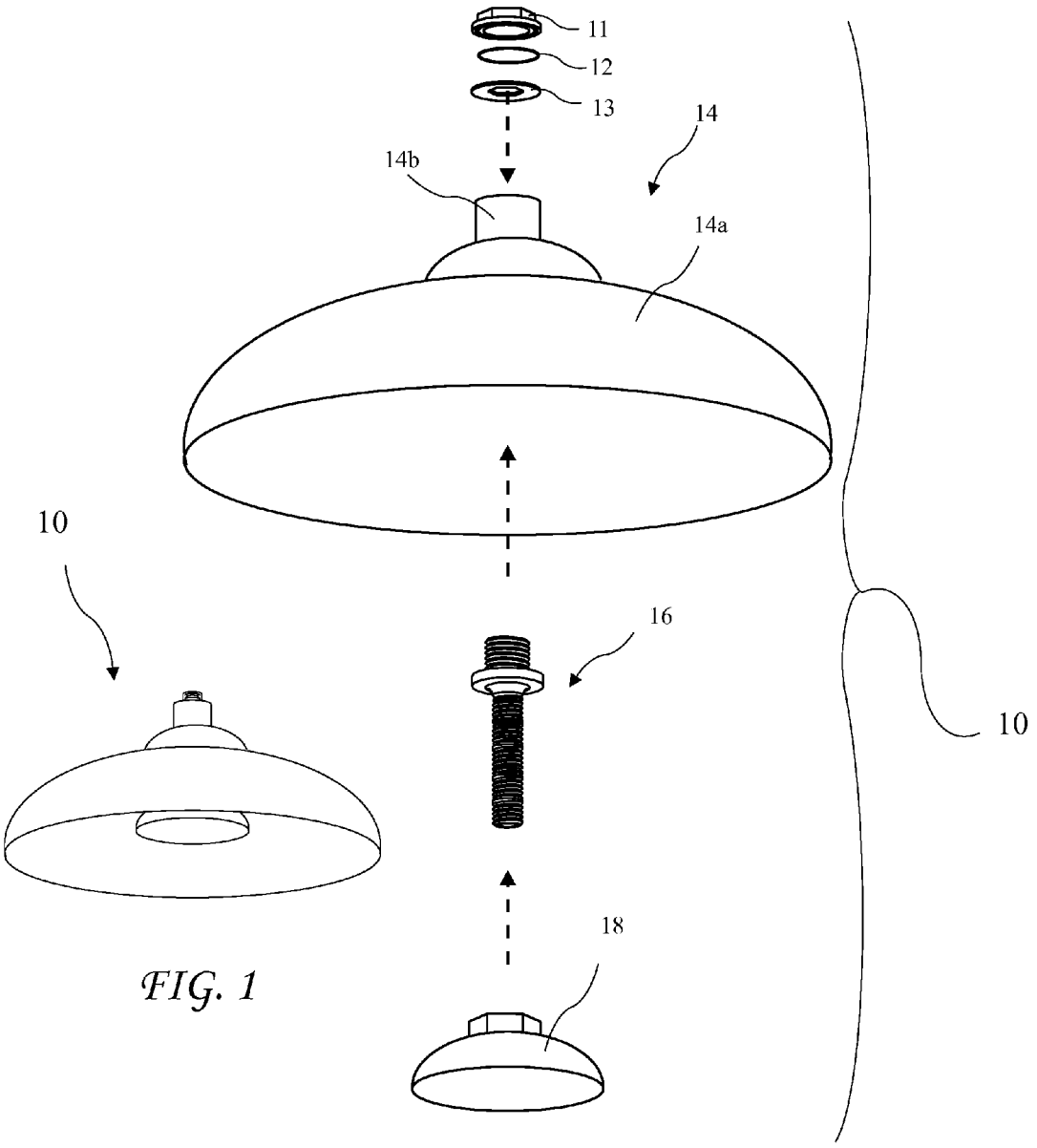
FIG. 1 is a perspective view of a light assembly according to the present invention.
FIG. 2 is a perspective view of the separate elements of the light assembly according to the present invention.

A perspective view of a light assembly 10 according to the present invention is shown in FIG. 1 and a perspective view of the separate elements of the light assembly 10 is shown in FIG. 2. The light assembly 10 includes a light fixture mounting post nut 11, an O-ring 12, a shaped washer 13, a light shade 14, a light fixture mounting post 16, and a light fixture 18. The light shade 14 includes a larger bowl shaped shading portion 14*a* and a smaller upper attaching portion 14*b* for attaching the light fixture mounting post 16. The light fixture 18 may be any fixture which may support a light and/or provide electrical connections to a light, or a second fixture which may support a light and/or provide electrical connections to a light.

Figure 3:
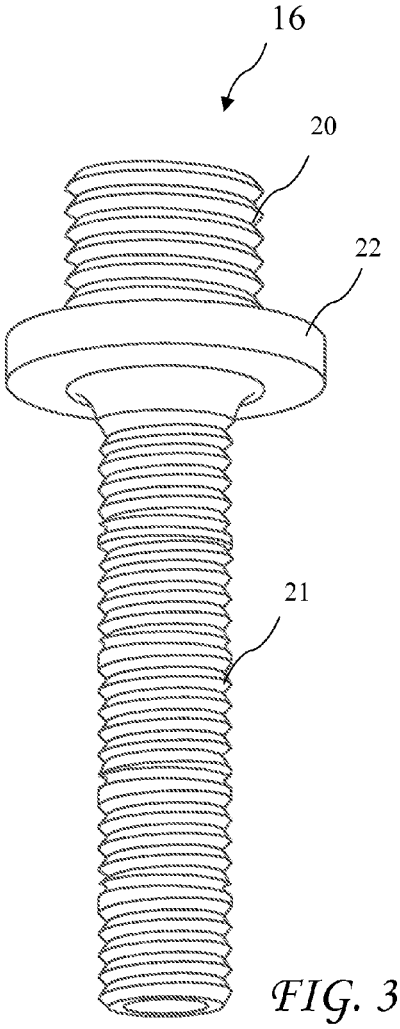
FIG. 3 is a perspective view of a light fixture mounting post according to the present invention.

A perspective view of the light fixture mounting post 16 is shown in FIG. 3. The light fixture mounting post 16 includes an upper portion 20 for attaching to the attaching portion 14*b*, a post flange 22, and a lower portion for attaching the light fixture 18.

Figure 4B:
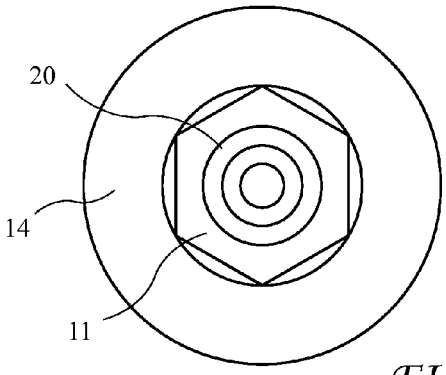
FIG. 4B is a top view of the light fixture mounting post attached to the light shade according to the present invention.
Figure 4A:
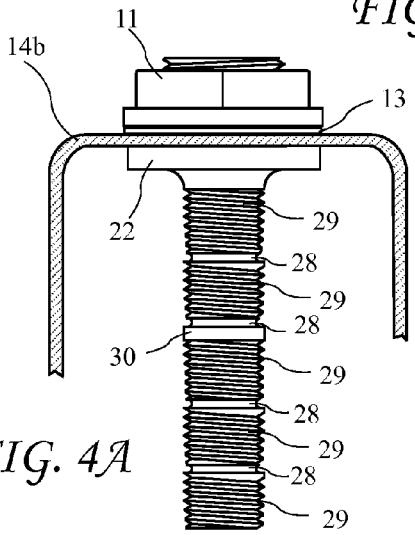
FIG. 4A is a side view of the light fixture mounting post attached to a light shade according to the present invention.
Figure 5:
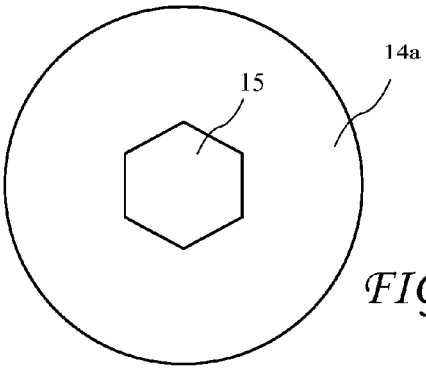
FIG. 5 shows a top view of a center of a light shade according to the present invention.
Figure 4C:
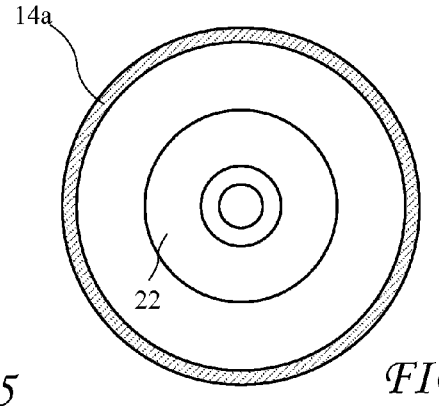
FIG. 4C is a bottom view of the light fixture mounting post attached to the light shade according to the present invention.

A side view of the light fixture mounting post 16 attached to the attaching portion 14*b* of the light shade 14 is shown in FIG. 4A, a top view of the light fixture mounting post 16 attached to the attaching portion 14*b* is shown in FIG. 4B, a bottom view of the light fixture mounting post 16 attached to the attaching portion 14*b* is shown in FIG. 4C, and a top view of a center portion of the lamp shade is shown in FIG. 5. The attaching portion 14*b* includes a non-round (for example, hexagonal) passage 15 and the light fixture mounting post 16 includes a cooperating non-round (for example, hexagonal) shoulder 34 (see FIG. 6A) on a flange 22 on the light fixture mounting post 16. The shoulder 34 engages the passage 15 to restrict or prevent rotation of the light fixture mounting post 16 once attached to the light shade 14, for example, when the light fixture 18 is attached to or detached from the light fixture mounting post 16. The shaped washer 13 is sandwiched between the nut 11 and light shade 14. The O-ring 12 is concealed between the nut 11 and shaped washer 13. While a hexagonal shaped shoulder 34 is preferred, any non-round shape may be sufficient to restrict rotation of the light fixture mounting post 16.

The mounting post 16 includes a left hand threaded upper portion 20 and a lower portion 21 having spaced apart tapered pipe threaded segments 29 separated by spaces 28. The lower portion 21 also includes an unthreaded shoulder 30 adjacent to a space 28 for extending threaded segments 29 below the unthreaded shoulder 30 downward. The unthreaded shoulder 30 provides additional length to the lower portion 21 which facilitates the attachment of known light fixtures. The spaces 28 preferably have reduced thickness to allow easier shortening of the lower portion 21.

Figure 6B:
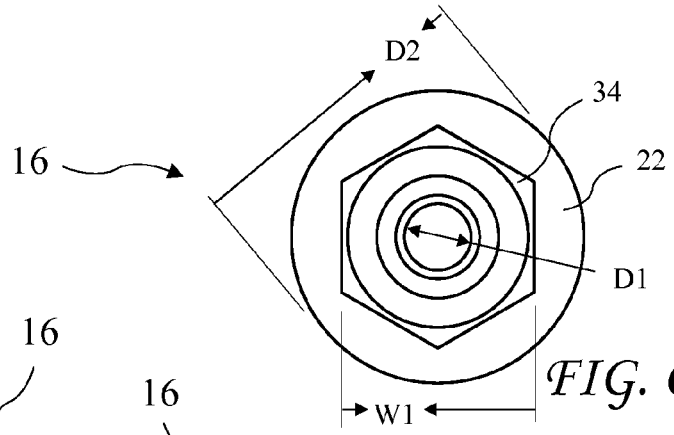
FIG. 6B is a top view of the light fixture mounting post alone according to the present invention.
Figure 7:
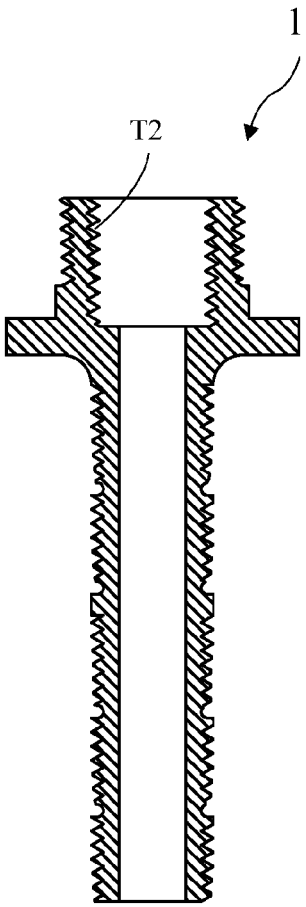
FIG. 7 is a cross-sectional view of the light fixture mounting post according to the present invention taken along line 7-7 of FIG. 6A.
Figure 6A:
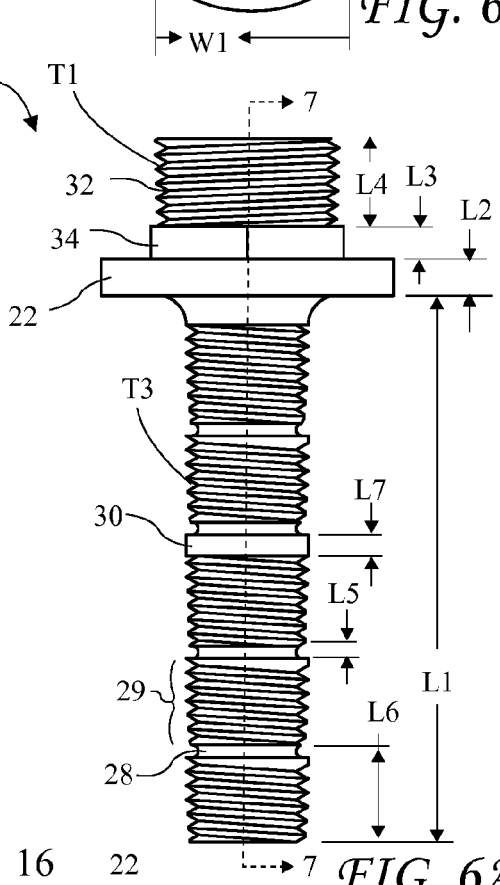
FIG. 6A is a side view of the light fixture mounting post alone according to the present invention.
Figure 6C:
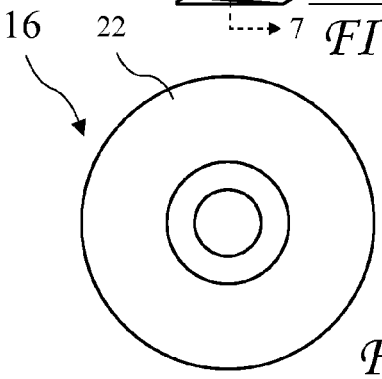
FIG. 6C is a bottom view of the light fixture mounting post alone according to the present invention.

A side view of the light fixture mounting post 16, according to the present invention, is shown in FIG. 6A, a top view of the light fixture mounting post 16 is shown in FIG. 6B, a bottom view of the light fixture mounting post 16 is shown in FIG. 6C, and a cross-sectional view of the light fixture mounting post 16 taken along line 7-7 of FIG. 6A is shown in FIG. 7. The flange 22 positions the light shade 14 on the mounting post 16 and the hexagonal shoulder 34 is formed on the flange 22.

The mounting post 16 includes left hand male threads T1 and female threads T2 on the upper portion 20 and male threads T3 on the lower portion 21.

The threads T1 are preferably ¾ inch or ⅞ inch National Pipe Thread (NPT) or National Pipe Straight (NPS).

The threads T2 are preferably ½ inch or ¾ inch and NPT or NPS by 14.

The threads T3 are preferably ½ inch or ¾ inch and NPT or NPS by 14.

The lower portion 21 has a length L1, the flange 22 has a length L2, the hexagonal shoulder 34 has a length L3, the threads T1 have a length L4, the spaces 28 between threaded segments 29 have a length L5, the threaded segments 29 have lengths L6, and the unthreaded shoulder 30 has a length L7. The hexagonal shoulder 34 has a land width W1, the mounting post 16 has an inside diameter D1, and the flange 22 has an outside diameter D2. The length L1 is preferably approximately 3.74 inches. The length L2 is preferably approximately 0.25 inches. The length L3 is preferably approximately 0.25 inches, the length L4 is preferably approximately 0.575 inches, the length L5 is preferably approximately 0.085 inches, the length L6 is preferably approximately 0.66 inches, the length L7 is preferably approximately 0.1445 inches, the width W1 is preferably approximately 1.3172 inches, the diameter D1 is preferably approximately 0.455 inches, and the diameter D2 is preferably approximately 1.3172 inches.

Figure 8B:
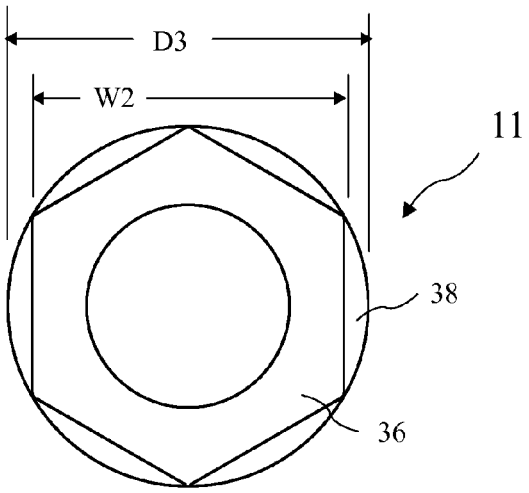
FIG. 8B is a top view of the light fixture mounting post nut according to the present invention.
Figure 8A:
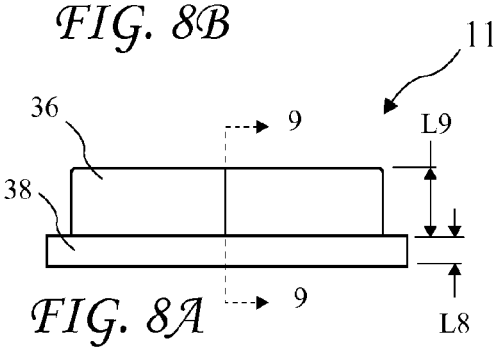
FIG. 8A is a side view of the light fixture mounting post nut according to the present invention.
Figure 9:
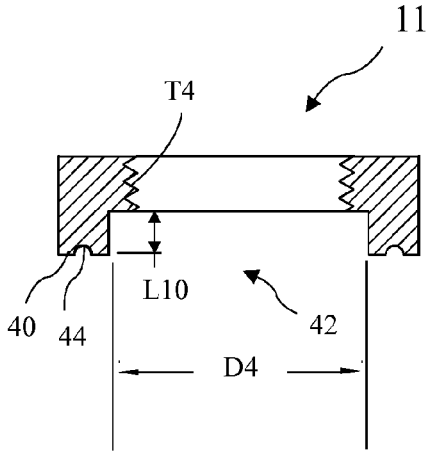
FIG. 9 is a cross-sectional view of the light fixture mounting post nut according to the present invention taken along line 9-9 of FIG. 8A.
Figure 8C:
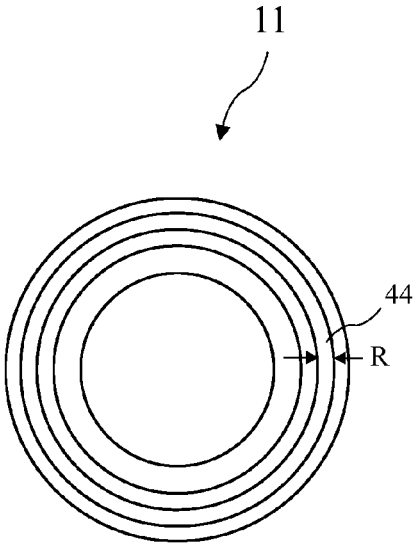
FIG. 8C is a bottom view of the light fixture mounting post nut according to the present invention.

A side view of the light fixture mounting post nut 11 according to the present invention is shown in FIG. 8A, a top view of the light fixture mounting post nut 11 is shown in FIG. 8B, a bottom view of the light fixture mounting post nut 11 is shown in FIG. 8C, and a cross-sectional view of the light fixture mounting post nut 11 taken along line 9-9 of FIG. 8A is shown in FIG. 9. The nut 11 includes a nut flange 38 and a nut hexagonal portion 36 extending from the nut flange 38. A nut recess 42 is preferably provided on a bottom surface 40 of the nut 11 providing clearance for any portion of the hexagonal shoulder 34 reaching above the light shade 14 (see FIG. 2). The bottom surface 40 further preferably includes an O-Ring recess 44 for accepting the O-Ring 12 (see FIG. 2). The post nut 11 includes female threads T4 for cooperating with male threads T1 (see FIG. 6A).

The nut flange 38 has a length L8 and diameter D3, and the nut hexagonal portion 36 has a length L9 and a land width W2. The length L8 is preferably approximately 0.177 inches, the diameter D3 is preferably approximately 2.08 inches, the length L9 is preferably approximately 0.391 inches, and the land width W2 is preferably approximately 1.8 inches. The nut recess 42 had a length L10 and a diameter D4, and the O-Ring recess 44 is preferably circular and has a semi-circular cross-section with a radius R. The length L10 is preferably approximately 0.25 inches, the diameter D4 is preferably approximately 1.5 inches, and the radius R is preferably approximately 0.05 inches.

Figure 10B:
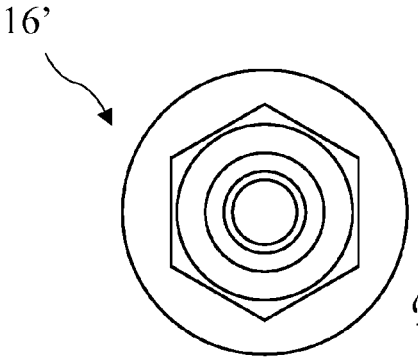
FIG. 10B is a top view of the second embodiment of the light fixture mounting post according to the present invention.
Figure 10A:
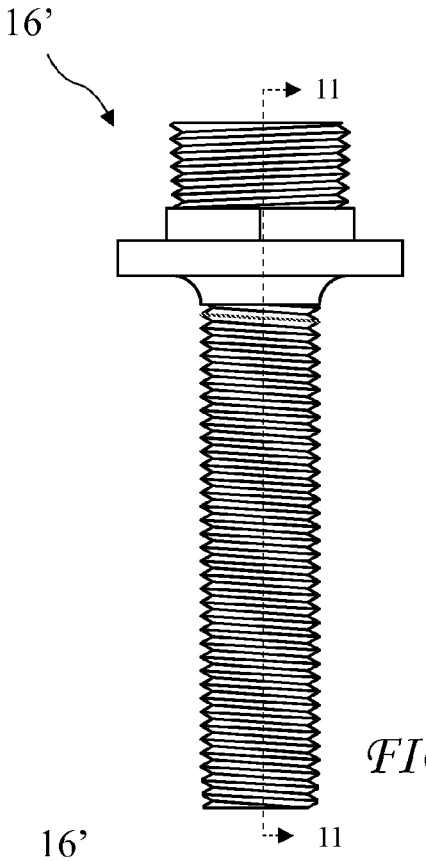
FIG. 10A is a side view of a second embodiment of the light fixture mounting post according to the present invention.
Figure 11:
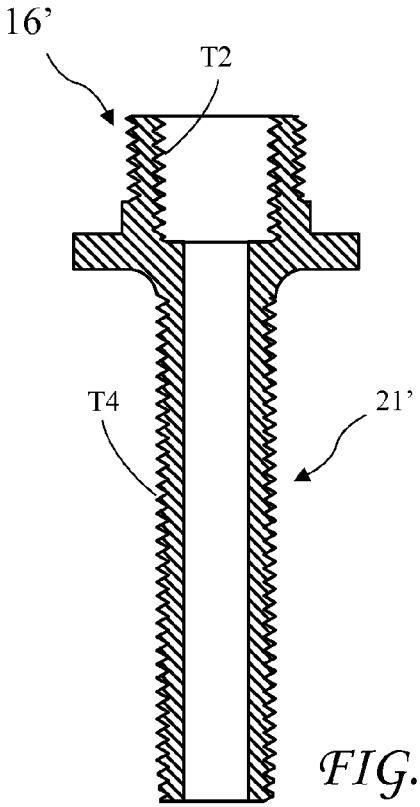
FIG. 11 is a cross-sectional view of the second embodiment of the light fixture mounting post according to the present invention taken along line 11-11 of FIG. 10A.
Figure 10C:
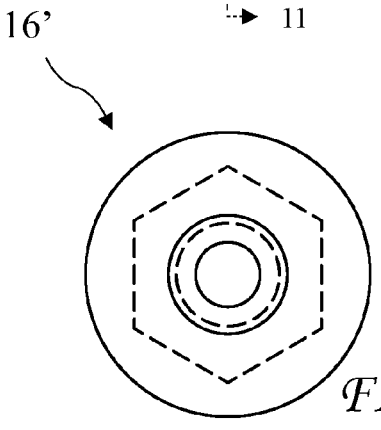
FIG. 10C is a bottom view of the second embodiment of the light fixture mounting post according to the present invention.

A side view of a second embodiment of the light fixture mounting post 16' according to the present invention is shown in FIG. 10A, a top view of the light fixture mounting post 16' is shown in FIG. 10B, a bottom view of the light fixture mounting post 16' is shown in FIG. 10C, and a cross-sectional view of the light fixture mounting post 16' taken along line 11-11 of FIG. 10A is shown in FIG. 11. The light fixture mounting post 16 is similar to the light fixture mounting post 16 except the lower portion 21' is continuous with threads T2 and T4 described above.

While the invention herein disclosed has been described by means of specific embodiments and applications thereof, numerous modifications and variations could be made thereto by those skilled in the art without departing from the scope of the invention set forth in the claims.

I claim:

1. A light fixture assembly comprising:

a light shade comprising:

an upper attaching portion having a non-round passage; and a lower shade portion;

a mounting post comprising:

a threaded upper portion;

a threaded lower portion for attaching a light fixture;

a flange separating the upper portion from the lower portion; and a non-round shoulder residing in the non-round passage and cooperating with the non-round passage to prevent rotation of the mounting post;

a post nut threadedly cooperating with the threaded upper portion for attaching the mounting post to the light shade; and a light fixture threadedly cooperating with the threaded lower portion of the mounting post for attaching the light fixture to the mounting post.

2. The light fixture assembly of claim 1, wherein a bottom surface of the post nut includes an O-Ring recess and an O-ring resides between the bottom surface of the post nut and the light shade.

3. The light fixture assembly of claim 1, wherein the lower portion is a threaded lower portion including a plurality of serially spaced apart threaded segments.

4. The light fixture assembly of claim 3, wherein the serially spaced apart threaded segments are separated by reduced thickness spaces (28) to allow easier shortening of the lower portion.

5. The light fixture assembly of claim 4, wherein the serially spaced apart threaded segments include a tapered National Pipe Thread (NPT) thread.

6. The light fixture assembly of claim 4, wherein the serially spaced apart threaded segments include a straight National Pipe Straight (NPS) thread.

* * * * *